United States Patent [19]

Semon

[11] Patent Number: 4,949,439

[45] Date of Patent: Aug. 21, 1990

[54] DRIP PAN FOR CASKETS

[75] Inventor: Joseph R. Semon, Eynon, Pa.

[73] Assignee: Casket Shells, Inc., Eynon, Pa.

[21] Appl. No.: 370,117

[22] Filed: Jun. 22, 1989

Related U.S. Application Data

[63] Continuation of Ser. No. 914,241, Oct. 2, 1986, abandoned.

[51] Int. Cl.[5] ..... A63G 17/00

[52] U.S. Cl. ..... 27/19; 27/11

[58] Field of Search ..... 27/1, 2, 7, 19, 11, 27/22, 23, 5

[56] References Cited

U.S. PATENT DOCUMENTS

| | | | |
|---|---|---|---|
| 52,756 | 2/1866 | Scollay | 27/5 |
| 675,679 | 6/1901 | Shaw | 27/5 |
| 2,247,617 | 7/1941 | Metz | 27/11 X |
| 2,882,584 | 4/1959 | Kidd | 27/11 |
| 3,435,494 | 4/1969 | Pothier | 27/11 |
| 3,964,140 | 6/1976 | Gauchard | 27/11 X |

FOREIGN PATENT DOCUMENTS

| | | | |
|---|---|---|---|
| 197811 | 11/1978 | Fed. Rep. of Germany | 27/19 |
| 1151167 | 1/1958 | France | 27/11 |
| 2532544 | 3/1984 | France | 27/7 |

*Primary Examiner*—Richard E. Chilcot, Jr.
*Attorney, Agent, or Firm*—Kane, Dalsimer, Sullivan, Kurucz, Levy, Eisele and Richard

[57] ABSTRACT

A drip pan is at the bottom of the casket for trapping and collecting body liquids during decomposition.

3 Claims, 2 Drawing Sheets

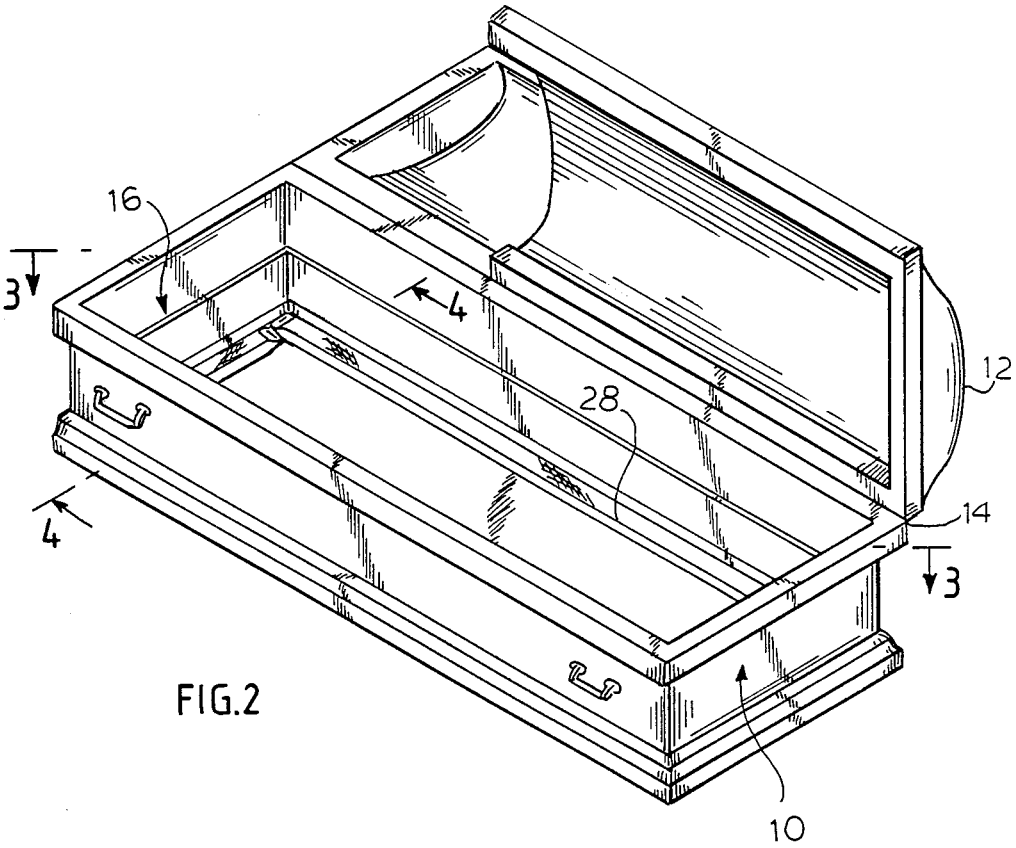
FIG.2
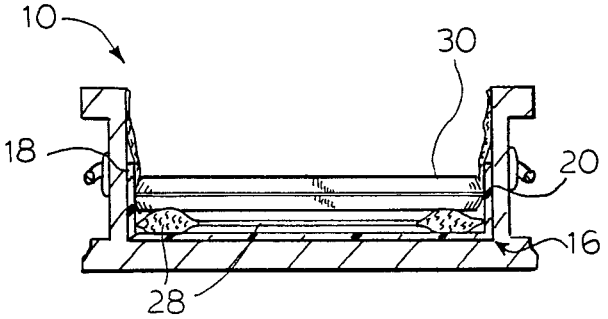
FIG.4
FIG.3
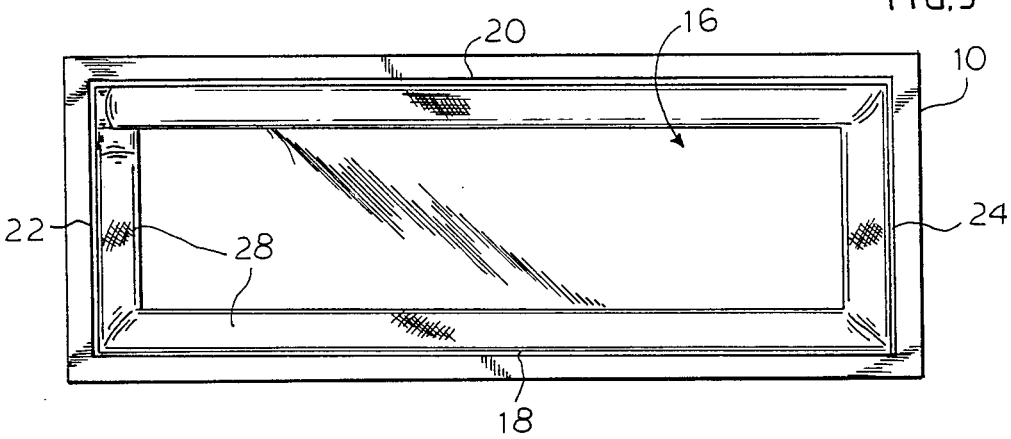

DRIP PAN FOR CASKETS

This is a continuation of co-pending application Ser. No. 914,241 filed on Oct 2, 1986 now abandoned.

BACKGROUND OF THE INVENTION

Above-ground burials in mausoleums have become very popular. It is well known to those skilled in the art that there are several causes of the decomposition of bodies placed in mausoleums. Some of these are related to the embalming and others to atmospheric conditions. It is not uncommon for the liquid products within the casket incident to decomposition to eventually penetrate through caskets containing the deceased and drip onto the floor causing severe consternation to the family, relatives and friends that may from time to time visit the mausoleum of the deceased.

OBJECTS AND SUMMARY OF THE INVENTION

It is an object of the present invention to provide a reliable and efficient sealing drip pan for a casket to trap and collect body liquids of decomposition and prevent their penetration and dripping from the casket.

An additional object of the present invention is to provide a drip pan that will make a proper seal between the casket side and end walls.

An additional objection of the present invention is to provide an absorbent pad for the pan to absorb liquid and which may also have a deodorant material to mask the odors of decomposition should they manage to escape from the casket.

With the above and other incidental objects in view as will more fully appear in the description below, the invention intended to be protected by Letters Patent consists of the features of construction, the parts and combinations thereof, and the mode of operation, as hereinafter described or illustrated in the accompanying drawings or in their equivalents.

BRIEF DESCRIPTION OF THE DRAWINGS

Referring to the accompanying drawing wherein the same reference characters refer to the same or like parts; and a preferred embodiment of the invention is shown:

FIG. 2 is a perspective view of a casket shown with its lid open and with the drip pan and absorbent pad in place;

FIG. 3 is top plan view of the casket of FIG. 2 taken along lines 3—3 of FIG. 2; and, FIG. 4 is a cross-sectional view taken along line 4—4 of FIG. 2.

DETAILED DESCRIPTION OF A PREFERRED EMBODIMENT

Figure 1:
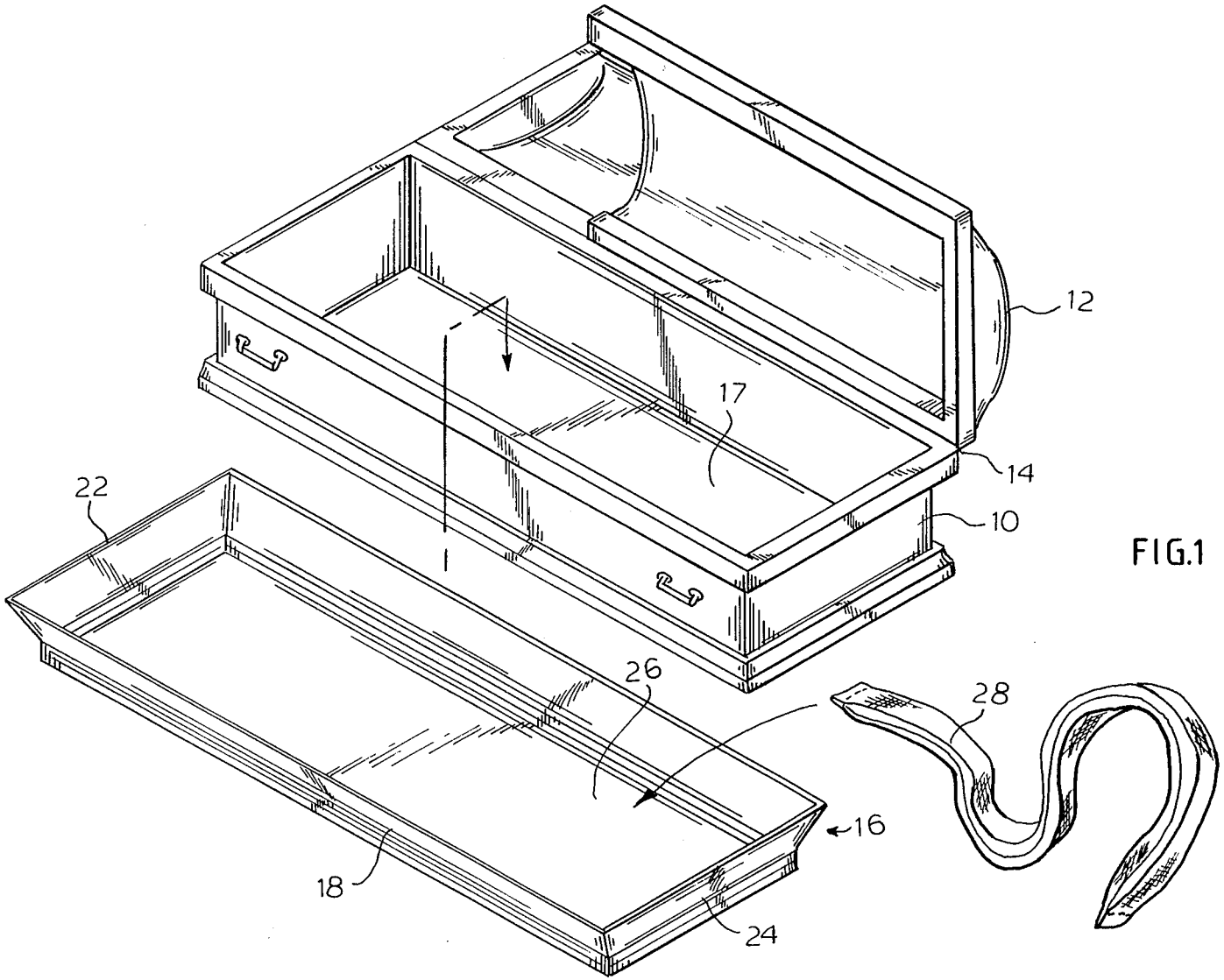
FIG. 1 is an exploded perspective view of the casket, and drip pan and absorbent pads of the present invention.

Referring more specifically now to FIG. 1, a conventional casket 10 has an open lid 12 hinged thereto along the length thereof at 14. A drip pan 16 of this invention is adapted to be received in the bottom section 17 of casket 10. The drip pan 16 is preferably molded in one piece with its sides 18 and 20 and ends 22 and 24 flared outwardly from the pan bottom 26. The bottom 26 will be slightly smaller in lateral dimension than the casket base section 17 to fit readily neatly therein. Under these circumstances the upper ends of the outwardly flared side 18 and 20 and ends 22 and 24 will firmly and sealingly engage the associated inner surfaces of the casket. This sealing engagement will act to prevent body liquids finding their way down to the base section 17 of the casket.

An absorbent pad 28 may be advantageously placed in the pan 16 in any desired location or orientation to effectuate absorbsion of body liquids of decompositions. The pad 28 may also contain a deodorant to mask the odor of decomposition should there be a gas leak through the casket.

As will be seen in FIG. 4 the drip pan 16 and pad 28 will be concealed by the bed shown generally at 30 which receives the deceased 32 and the lining 34.

It has been found that high density polyethylene may advantageously be utilized in forming the pan 16 and serves as a barrier keeping corrosive liquids from the casket shell material such as metal. This resin provides an inert barrier that resists formic acids formed as a result of decomposition chemical reactions.

While the above language specifically describes the best contemplated mode of the present invention in compliance with applicable statutes, it is not intended to limit the invention to the specific features shown, rather it is but one of several modes of putting the invention into practice, and therefore the invention is claimed in any of its forms of modifications within the legitimate and valid scope of any of the appended claims.

What is claimed is:

1. A casket sealing system which comprises a casket for receiving a deceased and having a base section and substantially perpendicular sides and ends extending upwardly therefrom, support means for supporting the deceased above the base, a pan of resinous material inserted beneath the support means for trapping and collecting body liquids of decomposition, said pan being integrally molded in one piece, said pan having a bottom resting in the base section, and sides and ends extending upwardly therefrom in proximity of the sides and ends respectively of the casket and extending beyond the support means a sufficient distance to collect fluids of decomposition, the bottom of the pan being slightly smaller in lateral dimension than the casket base section to fit readily neatly in the casket, the upper edges of the side and ends of the pan being substantially contiguous to the sides and ends, respectively of the casket, said sides and ends of the pan are flared outwardly from the bottom and into firm sealing engagement with the sides and ends respectively of the casket to cooperate in preventing body liquids finding their way down to the base section of the casket.

2. The invention according to claim 1 further including a deodorant pad on the bottom of the pan.

3. The invention of claim 1 wherein the pan is molded of high density polyethylene.

* * * * *